US006651746B2

(12) United States Patent
Boyd

(10) Patent No.: US 6,651,746 B2
(45) **Date of Patent: *Nov. 25, 2003**

(54) HIGH TORQUE AND HIGH CAPACITY ROTATABLE CENTER CORE AND FLOATABLE SEALED BODY ASSEMBLIES WITH UNIVERSALS RAM APPLICATIONS AND METHOD

(76) Inventor: Anthony R. Boyd, 2204 Turnberry Dr., Loreauville, LA (US) 70552

( * ) Notice: Subject to any disclaimer, the term of this patent is extended or adjusted under 35 U.S.C. 154(b) by 0 days.

This patent is subject to a terminal disclaimer.

(21) Appl. No.: 10/190,193

(22) Filed: Jul. 3, 2002

(65) Prior Publication Data

US 2003/0098161 A1 May 29, 2003

Related U.S. Application Data

(63) Continuation-in-part of application No. 09/994,161, filed on Nov. 26, 2001.

(51) Int. Cl.[7] ..... E21B 33/06

(52) U.S. Cl. ..... 166/379; 166/84.1; 166/85.4; 166/86.3; 166/386; 166/387; 175/57; 175/317; 251/1.3

(58) Field of Search ..... 166/85.4, 86.3, 166/84.3, 84.1, 386, 373, 379, 387; 175/57, 317; 251/1.3

(56) References Cited

U.S. PATENT DOCUMENTS 1,723,934 A * 8/1929 Heggem ..... 166/84.1
1,854,058 A * 4/1932 Otis ..... 277/325
3,145,995 A * 8/1964 Adamson et al. ..... 166/53
3,163,430 A * 12/1964 Normand ..... 166/84.1
4,043,389 A * 8/1977 Cobb ..... 166/55
4,860,826 A * 8/1989 Land ..... 166/86.3
5,161,617 A * 11/1992 Marschke ..... 166/298
5,645,098 A * 7/1997 Morrill ..... 137/15.18
6,113,061 A * 9/2000 Van Winkle ..... 251/1.3
6,223,819 B1 * 5/2001 Heinonen ..... 166/85.4
6,244,336 B1 * 6/2001 Kachich ..... 166/55

* cited by examiner

*Primary Examiner*—Hoang Dang
(74) *Attorney, Agent, or Firm*—Dominque & Waddell, PLC

(57) ABSTRACT

A high torque and high capacity rotatable center core and floatable sealed body apparatus with universal ram applications. The apparatus includes a central core assembly, connected between a swivel on its upper end and the work string below, with the central core assembly having a central passageway therethrough. The apparatus further includes a first outer assembly, having a central bore for slidably engagement around a portion of the central core assembly. In one embodiment, a second outer assembly is included, with the second outer assembly having a central bore for slidably engaging around a portion of the central core assembly above the first outer assembly. A pair of opposing transverse bores is contained within both of the first and second outer assemblies, corresponding to a pair of transverse bores in the central core assembly. The apparatus further includes sleeve members for aligning the bores of the central core assembly and the first and second outer assemblies; and rams positional in the transverse bores in the first and second outer assemblies for sealing off the passageway in the central core assembly when moved to the sealing position. A method of sealing a work string on a drill rig is also disclosed.

39 Claims, 11 Drawing Sheets

HIGH TORQUE AND HIGH CAPACITY ROTATABLE CENTER CORE AND FLOATABLE SEALED BODY ASSEMBLIES WITH UNIVERSALS RAM APPLICATIONS AND METHOD

CROSS-REFERENCE TO RELATED APPLICATIONS

This application is a continuation-in-part of my application filed Nov. 26, 2001 and bearing Ser. No. 09/994,161.

BACKGROUND OF THE INVENTION

1. Field of the Invention

The system of the present invention relates to high torque and high capacity rotatable center core and floatable seal body assemblies with universal ram applications and the method of undertaking same. More particularly, the present invention relates to an apparatus that would allow one to pick up the entire weight of the drill string tubing or pipe which would allow one to rotate from the top and have the torque completely through it while rotating.

2. General Background of the Invention

In undertaking wireline work utilizing a side entry device in the present state of the art, the device includes a packoff assembly or grease seal assembly at the entry to the side entry port or top entry port which provides for protection against blowouts while the device is in use. However, while wireline is being lowered through the device, there must be an additional method to seal off the passageway while the wireline is in place. Therefore, there are provided blowout preventors positioned below the wireline packoff on the side entry device which may be manually or hydraulically closed to seal oft the wireline in case of a blowout. Such blowout preventors are manufactured by, for example, Bowen Inc. under the name.

However, it would be beneficial to have such a blowout preventor located in the drill string itself, above the rig floor, which would allow the wireline to be sealed off below the swivel. In that manner, when the drill string below the swivel needs to be rotated to provide torque, the blowout preventors would simply rotate with the drill string. However, in the case of a blowout, or in the event work needed to be done above the swivel above this side entry device, while the well is under pressure, the blowout preventors could be closed off. The type of blowout preventors currently used, as discussed above, manufactured by Bowen Inc., would not have the capability of being placed within the drill string, since the device could not withstand the enormous weight of the drill string below the preventors. So, there is a need for a type of blowout preventors that can be positioned below the swivel, within the drill string, that can be maintained open, and allow to rotate freely with the string, but in the event work needed to be done above the device, the blowout preventors would be closed, and the well, although under pressure would not be capable of blowing out during the curative work. The system of the present invention solves many problems in the art.

BRIEF SUMMARY OF THE INVENTION

An apparatus for use in a drill string is disclosed. The apparatus comprises an inner core assembly having a first and second transverse bore, and has a shoulder formed thereon. A first outer core assembly is slidably disposed about the inner core assembly and rests on the shoulder. The outer core assembly has a first and second transverse bore that is aligned with the first and second transverse bore of said inner core assembly.

The apparatus further comprises a first piston means, disposed within the first and second transverse bore of the outer core assembly, for closing an internal longitudinal bore of the inner core assembly. The apparatus further comprises a ring inserted into an indentation on the inner core assembly, with the ring abutting a top surface of the outer core assembly. A pin means for maintaining the inner core assembly in line with the first outer core assembly may also be included. In one of the preferred embodiments, the inner core assembly is connected at one end to a drill string and at the other end to a swivel.

In one embodiment, the first piston means comprises a first piston member disposed within the first transverse bore of the outer core assembly, a second piston member disposed within the second transverse bore of the outer core assembly, and means for moving the first and second piston member into the internal longitudinal bore of the inner core assembly in order to close seal the internal bore. The first piston member may include a first sleeve disposed within the first transverse bore of the outer core assembly; and the second piston member may include a second sleeve disposed within the second transverse bore of the outer core assembly.

In one of the embodiments, the apparatus further comprises a third and fourth transverse bore positioned within the inner core assembly and a third and fourth transverse bore positioned within the first outer core assembly that is aligned with the third and fourth transverse bore of the inner core assembly. A second piston means, disposed within the third and fourth transverse bore of the outer core assembly, is included for closing the internal longitudinal bore of the inner core assembly.

In another embodiment, a second outer core assembly is slidably disposed about the inner core assembly and rests on a first outer surface of the first outer core assembly, and wherein the second outer core assembly has a third and fourth transverse bore that is aligned with a third and fourth transverse bore located within the inner core assembly. With this embodiment, a second piston means, disposed within the third and fourth transverse bore of the second outer core assembly, is included for closing the internal longitudinal bore of the inner core assembly. In this embodiment, the first and second piston means comprises: a first piston member disposed within the first transverse bore of the first outer core assembly; a second piston member disposed within the second transverse bore of the first outer core assembly; a third piston member disposed within the third transverse bore of the second outer core assembly; a fourth piston member disposed within the fourth transverse bore of the second outer core assembly; and, means for moving the first, second, third, and fourth piston members into the internal longitudinal bore in order to close the internal longitudinal bore.

A method of sealing off flow in a work string is also disclosed. The method comprises providing an apparatus containing an inner core assembly having a first and second transverse bore, and a shoulder formed thereon; a first outer core assembly slidably disposed about the inner core assembly and resting on the shoulder, the outer core assembly having a first and second transverse bore that is aligned with the first and second transverse bore of the inner core assembly; first piston means, disposed within the first and second transverse bore of the outer core assembly, for closing an internal longitudinal bore disposed through the inner core assembly.

The method further comprises connecting the work string to the inner core assembly and transmitting the weight of the drill string to the inner core assembly. Next, the work string is rotated so that a torque is created, and the torque is transmitted through the inner core assembly. The rotation of the work string is terminated. The first piston means is closed in order to close off the internal longitudinal bore of the inner core assembly. Next, the first piston means is opened thereby opening the internal longitudinal bore.

A concentric work string, such as wireline, is provided within the internal longitudinal bore. The concentric work string may have attached thereto a down hole assembly. The concentric work string is run down the work string with the down hole assembly. Next, the first piston means is closed about the wireline within the internal longitudinal bore. Curative work may be performed on the wireline above the first piston means. Next, the first piston means is opened so that the internal longitudinal bore is unsealed. The concentric work string can then be pulled from the work string.

In another embodiment, at least one blowout preventor is positioned within the drill string, above the rig floor, between a swivel and a length of drill pipe below. The apparatus includes an outer core assembly (sometimes referred to as a principal body portion) having a central bore for accommodating an inner core assembly (sometimes referred to as a central assembly), having a first end attached to the lower end of the swivel, and a lower end attached to the drill pipe below. The inner core assembly would include a central bore for accommodating the passage of fluid, tubulars and/or wireline therethrough; there is further provided a pair of transverse bores which would be aligned with the pair of traverse bores in the outer core assembly so as to provide a piston within the bores, capable of moving into the central bore of the inner core assembly to seal the cental bore from flow therethrough; there is further provided a sleeve slidably engaged within the transverse bores for aligning the bores of the body and the inner core assembly; the inner core assembly would provide an annular shoulder around its lower portion so that the outer core assembly would rest upon when the transverse bores are aligned; there would be provided an upper ring in the wall of the inner core assembly to maintain the outer core assembly in place between the shoulder and the upper ring; further, there are provided sealing rings to prevent fluid in the pistons of the apparatus from seeping into other parts of the assembly. There may be provided a plurality of the blowout preventors stacked one upon the other, which would allow multiple sealing off of the wireline, or other small pipe as wash pipe or coiled tubing, but would not be interconnected so as to avoid potential stretching when the inner core assembly must take the weight of the drill string down hole.

The apparatus and method involved would allow one to pull on a center core and have the block with the rams without exerting any pull on the outside body of the block, which would allow one to rotate the drill string without having the torque on the outer core assembly exerted. By using a separate outer core assembly in the system, if the inner core assembly would have stretch and torque, the outer core assembly would be spared from the same stretch and/or torque.

This system could be used when the wire of a wireline unit balls up under the pack off or grease head flow tubes. The operator could close off the apparatus and perform the curative work desired above the apparatus. If an unexpected pressure is exerted on the well, in order to correct the problem, one will close the rams in order to seal off the pressure; then the operators would bleed off above the rams. If one has a pump down tool below the rams, this would allow one to pump fluids downhole if one would need to kill the well.

A method of sealing off flow in a tubular string while using a concentric work string is also disclosed. The concentric work string can be a coiled tubing string. The method comprises providing a sealing apparatus having an inner core assembly and an outer core assembly. The method includes connecting the tubular string to a first end of the inner core assembly and connecting a swivel to a second end of said inner core assembly. Next, the weight of the tubular string is transmitted to the inner core assembly, and the coiled tubing is lowered into the tubular string and through the internal bore of the inner core assembly, and wherein the coiled tubing disposed within the tubular string creates an annular space.

The method further includes rotating the tubular string so that a torque is created, and transmitting the torque through the inner core assembly. Rotation of the tubular string is terminated and the piston means is closed about the coiled tubing in order to seal off the annular space. Next, a fluid is pumped through a side entry sub located below the apparatus, the fluid being pumped into the annular space.

The method further comprises opening the piston means so that the annular space is unsealed and running into the well bore with the coiled tubing to a desired depth. Next, the piston means is closed about the coiled tubing thereby closing the annular space. The method may further comprise opening the piston means so that the annular space is opened and pulling force may be exerted on the tubular string. The weight of the tubular string is transmitted through the outer core assembly. Rotation of the tubular string creates torque which is transmitted to the outer core assembly. Rotation may be stopped and the coiled tubing is pulled out of the tubular string.

It is a principal object of the present invention to provide a blowout preventor system above the rig floor within the drill string to allow sealing off of downhole pressure in order to do work on a side entry or top entry device above the swivel.

It is a further object of the present invention to provide a blowout preventor system in the drill string above the rig floor which can withstand the weight of the drill string without damage to the blowout preventors.

It is a further object of the present invention to provide a blowout preventor system in the drill string above the rig floor which would allow for a plurality of separate outer core assemblies aligned in sequence. This embodiment allows the apparatus to withstand the weight of the drill string but avoid the outer core assembly from being damaged.

It is a further object of the present invention to include a method and apparatus, which would provide a blowout preventor type of seal assembly in the drill string that would allow one to pick up the entire weight of the drill string tubing or pipe and still be able to rotate from the top and have the torque completely go through the apparatus in order to rotate the pipe below it.

It is a further object of the present invention to provide a system which would allow tools or pipe to enter down the center bore of the apparatus, and would allow the apparatus to be closed to control downhole well pressure in the event any tools or pipe above it would need to be worked or changed. Thus, curative work could be performed while controlling well pressure below the apparatus.

It is a further object of the present invention to provide a system for use on chemical cutting or regular logging applications where you can use with high pressure tubing connections or high pressure connections that includes a grease head on top to control well pressure. This would allow one to eliminate the Bowen quick connections which are normally used without elevators and would not have pulled on the tubing below.

It is a further object of the present invention to provide a system which is applicable when doing many types of applications, for instance, the operator is able to pull while chemical cutting the pipe below with heavy loads and still have the availability to rotate the pipe. Prior art blow out preventors cannot rotate or withstand heavy loads. The present invention solves these problem.

An advantage of the High Torque and High Capacity Rotatable Center Core and Floatable Sealed Body Assemblies with Universal Ram Applications and Method is that in the present state of the art, there are no drill pipe blow out preventors (BOP) with seal assemblies that would allow one to pick up the entire weight of the drill string, tubing or pipe without damaging the apparatus. Furthermore, there are no current BOP assemblies which would enable one to rotate from the top and have the torque completely go through the BOP assembly to rotate the pipe below the assembly. The apparatus of the present invention will rotate with the pipe. It could be used when the wireline strands in the grease head and on the pack off assembly have a leak or any of the connections above the assembly within the lubricator are leaking. With the use of the apparatus of the present invention, one would be able to hold the load of the drill string and seal off on any items such as wireline that the seals are installed to fit, and in turn, the operator could correct the problems above the apparatus.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Figure 1A:
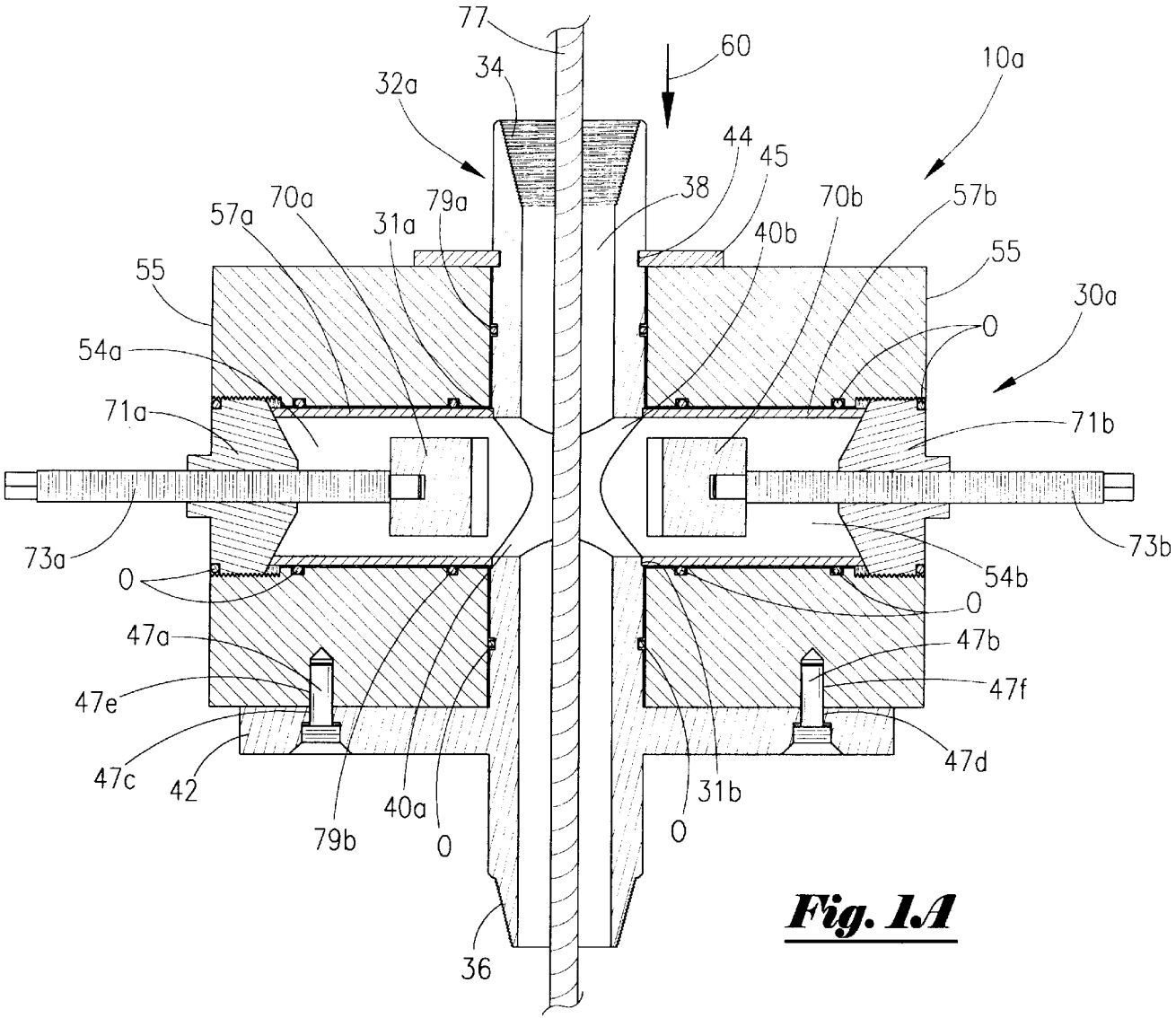
FIG. 1A is a cross-section view of the apparatus, which is one of the preferred embodiments of the present invention.

FIGS. 1–14 illustrate the preferred embodiments of the apparatus and system of the present invention as would be utilized in a work string, such as a drill string. Referring to FIG. 8, the apparatus 10*a*, which may be referred to as a high torque floatable seal body assembly, would be threadedly connected to a drill string 16 below a locking or regular swivel 14. In effect, the high torque floatable seal body apparatus 10*a* would be an apparatus for use as a blowout preventor within the drill string 16 above the rig floor 18, as seen in FIG. 8.

Prior art blowout preventors were placed below a packoff 20 of a side entry device 22.

Figure 1B:
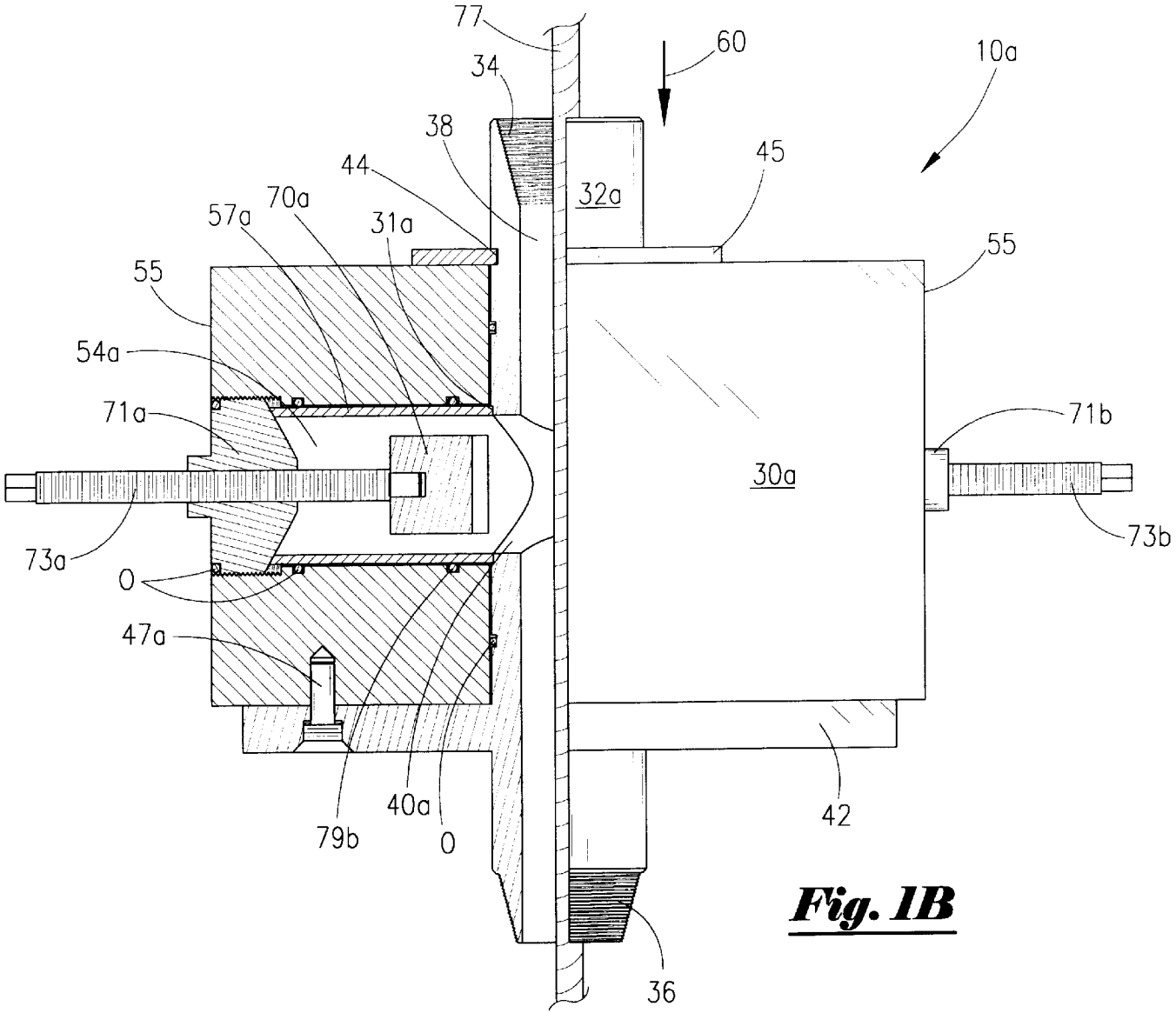
FIG. 1B is a partial cross-section view of the apparatus seen in FIG. 1A.
Figure 5:
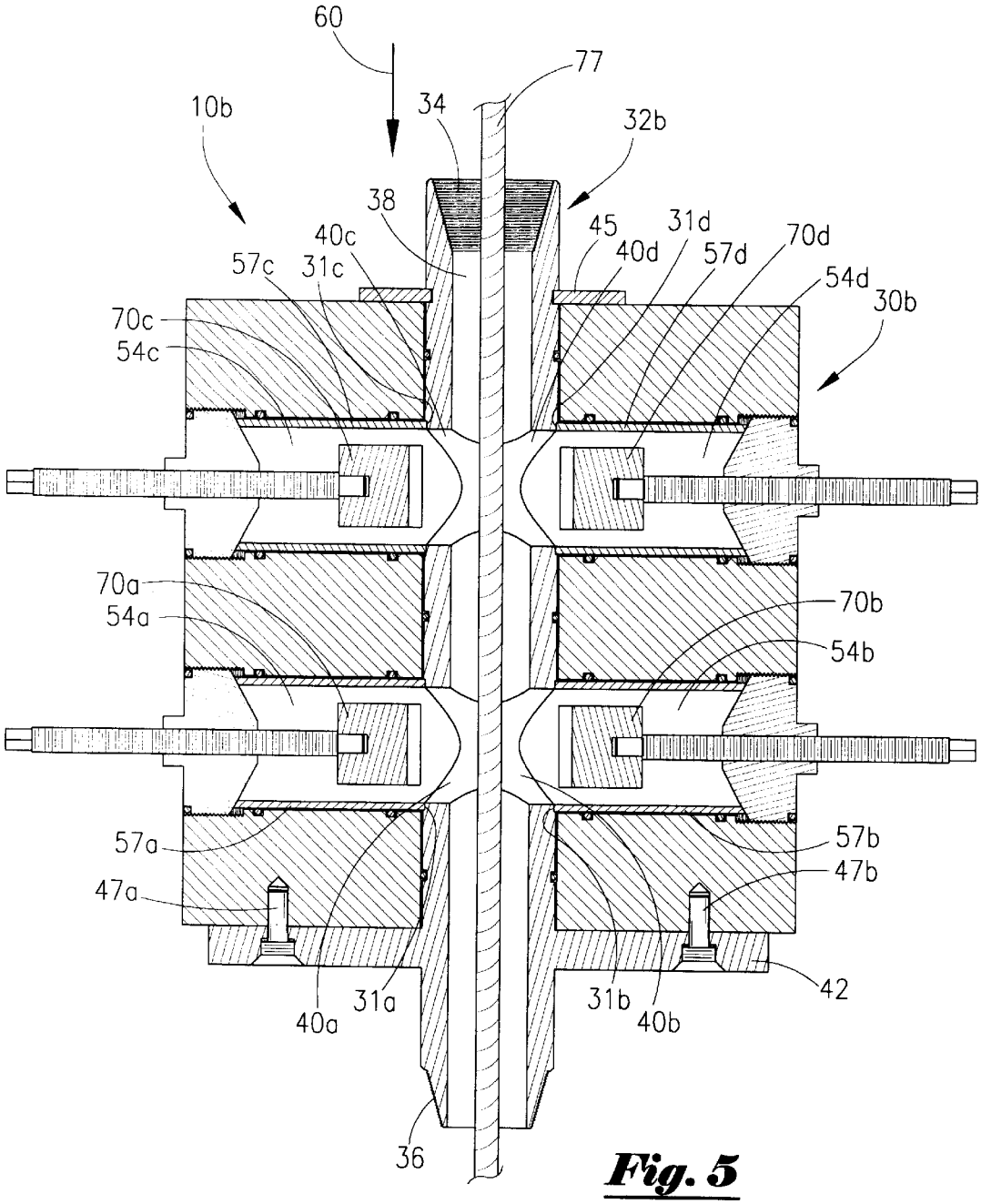
FIG. 5 is a cross-section view of a second embodiment of the apparatus having a composite double outer core assembly.
Figure 9:
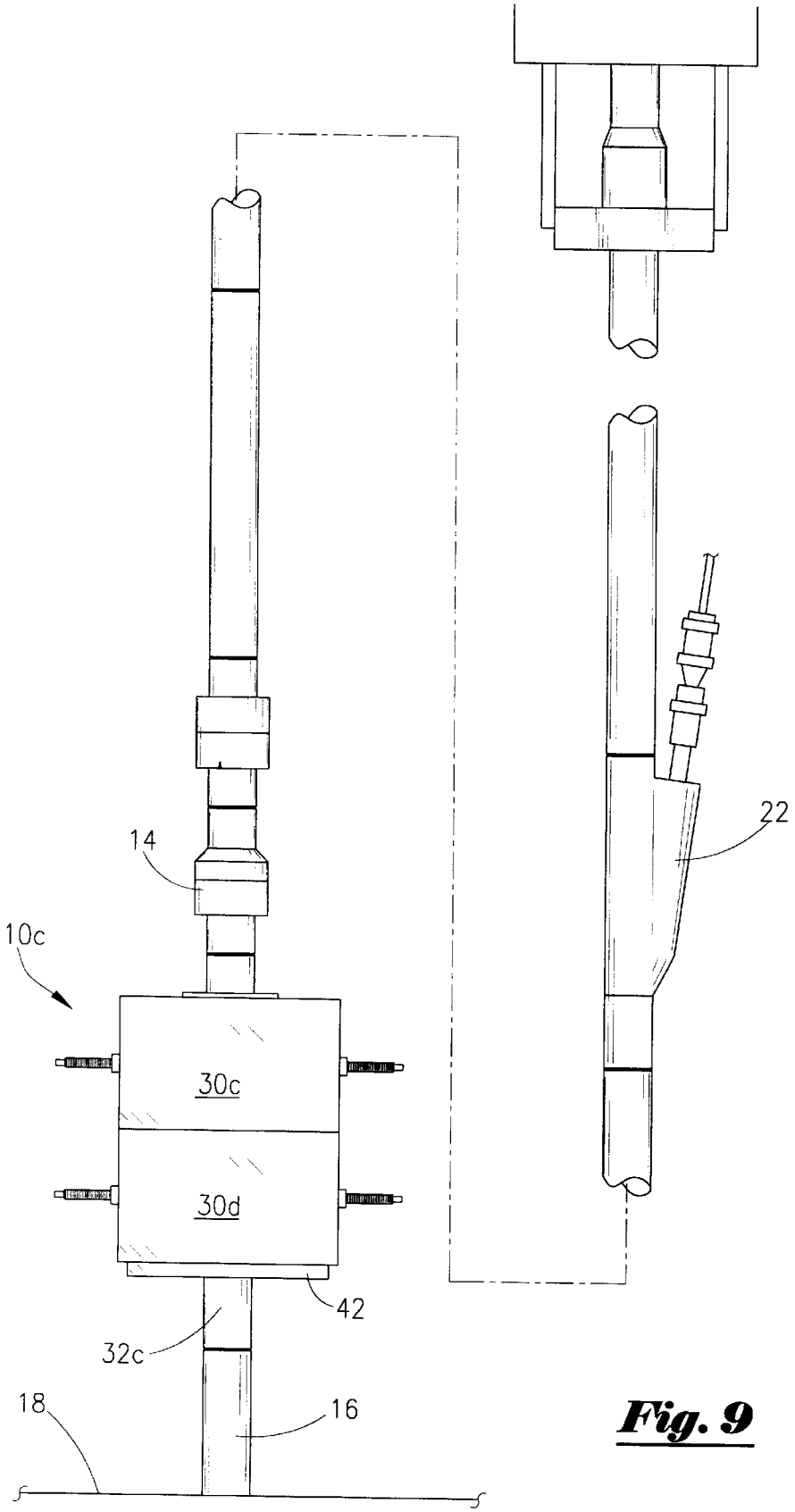
FIG. 9 is a schematic illustration of a third embodiment of the apparatus having a pair of outer core assemblies positioned below a swivel for use during wireline work in the drill string above the rig floor.

In operation, the apparatus could be utilized as a single apparatus as seen in FIGS. 1A and 1B; or, a pair of outer core assemblies, positioned atop one another, as seen in FIG. 9; or, as a composite double outer core assembly as seen in FIG. 5. In each configuration, the operation of the apparatus would be to carry out the same function.

Reference is made to FIG. 1A where is seen a cross section view of the single apparatus 10*a* which includes the outer core assembly 30*a*, and an inner core assembly 32*a* having a threaded portion 34 on its upper end and a male threaded portion 36 on its lower end. The upper threaded end 34 would connect to the lower end of the swivel, for example, 14, as seen in FIG. 8, and the lower end 36 of the inner core assembly 32*a* would attach to the section of drill pipe 16, as illustrated in FIG. 8.

The inner core assembly 32*a* includes a continuous longitudinal bore 38 therethrough, as seen in FIGS. 1A and 1B, for allowing the flow of fluids or other concentric items such as coiled tubing or wireline therethrough as it is interconnected between the swivel and the length of drill pipe as is appreciated by those of ordinary skill in the art. It should be noted that like numbers appearing in the various figures refer to like components.

As seen in FIG. 1A, the inner core assembly 32*a* would also include a radial transverse bore 40*a* extending across its entire width which would intersect the vertical bore 38 therethrough. Transverse bore 40*a* would house piston 70*a* therein as would be described further. A second bore 40*b* and second piston 70*b* are disposed within the apparatus 10*a*.

The inner core assembly 32*a* further provides a substantial shoulder portion 42, as seen in FIG. 1A, for allowing the outer core assembly 30*a* to rest thereupon, as will be discussed further, during use of the apparatus 10*a*. Further, there is noted an annular indentation 44 around the wall of inner core assembly 32*a* which would house a ring 45 (sometimes referred to as sleeve 45) which would maintain the outer core assembly 30*a* to rest on shoulder 42, again as will be discussed further.

As further seen in FIG. 1A, expanded shoulder 42 would hold the outer core assembly 30*a* in line by pin members 47*a*, 47*b* that will maintain the outer core assembly 30*a* and allow rotation with the inner core assembly 32*a*. Pin members 47*a*, 47*b* are inserted into apertures 47*c*, 47*d* in the shoulder 42 and corresponding apertures 47*e*, 47*f* in outer core assembly 30*a*. The pin members 47*a*, 47*b* will allow slight longitudinal movement up and down as the weight of the drill string creates a certain amount of stretch. The pin members 47*a*, 47*b* are large enough to keep the inner core assembly 32*a* and the outer core assembly 30*a* rotating together and keeps the entire apparatus 10*a* in line. The pin members 47*a*, 47*b* may be attached to the shoulder 42 by conventional means such as thread engagement.

The ring 45 slides on the upper portion of the inner core assembly 32*a* and would be locked as seen in FIG. 1B. The ring 45 will keep the outer core assembly 30*a* in line with inner core assembly 32*a* so that under heavy loads, although inner core assembly 32*a* may have stretch, the ring 45 will allow inner core assembly 32*a* to stay in line. When the apparatus 10*a* is required to be activated i.e. closed, the pistons 70*a*, 70*b* will properly seal since there is no bending motion or torque on the outer core assembly 30*a*. The pistons may be referred to as rams.

Figure 2:
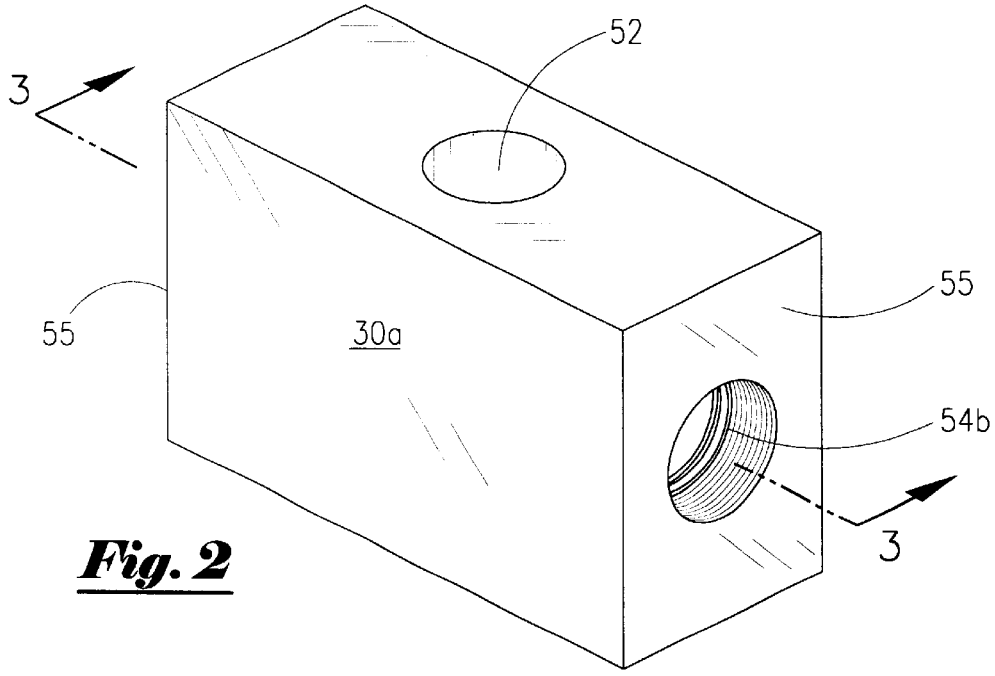
FIG. 2 is a perspective view of the outer core assembly of the apparatus seen in FIGS. 1A and 1B of the present invention.
Figure 3:
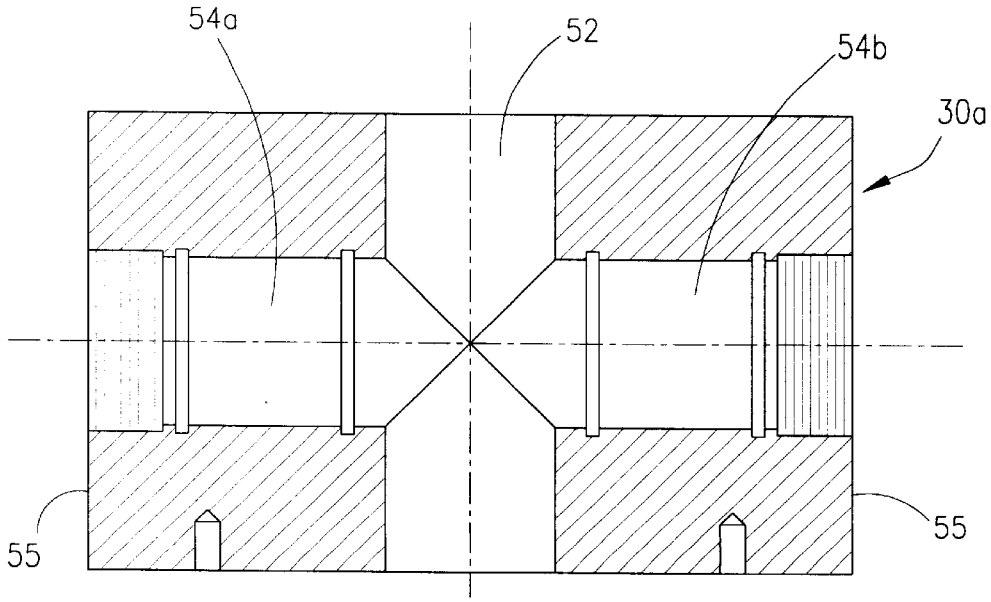
FIG. 3 is a cross-section view of the outer core assembly taken from line 3—3 of FIG. 2.

Turning to FIGS. 2 and 3, there is illustrated the outer core assembly 30*a* which in the preferred embodiments is either a substantially cubical shape but can also be a circular shaped block. The outer core assembly 30*a* seen in FIG. 2 contains a first vertical bore 52, the bore 52 having an interior diameter substantially equal to the exterior diameter of inner core assembly 32*a*. The inner core assembly 32*a* will be disposed within the bore 52. There would further be provided transverse bores 54*a*, 54*b* extending through each end 55 of the outer core assembly 30*a* which would be in communication with the bore 52. FIG. 3 depicts a cross-sectional view of the outer core assembly 30*a* seen through line 3—3 of FIG. 2.

Referring again to FIG. 1A, the two bodies 30*a* and 32*a* work in combination. That is, the outer core assembly 30*a* would be slidably engaged upon the upper end of inner core assembly 32*a* in the direction of arrow 60 seen in FIG. 1A, so that the outer core assembly 30*a* would then come to rest upon the upper surface of shoulder 42. When coming to rest on shoulder 42, the transverse bores 54*a*, 54*b* of outer core assembly 30*a* would be in alignment with transverse bore 40*a*, 40*b* respectively in the inner core assembly 32*a*, and would be maintained in line by the pin members 47*a*, 47*b* as described earlier. It should be noted that bores 54*a*, 54*b* would be aligned with bores 40*a*, 40*b* respectively. When that particular alignment is complete, there would then be provided the ring 45 which as seen in FIG. 1A, placed into the groove 44 in the wall of inner core assembly 32*a*, so as to maintain the outer core assembly 30*a* between the shoulder 42 and the ring 45 so that the outer core assembly 30*a* would minimally move up and down during use.

In FIG. 1A, outer core assembly 30*a* is illustrated resting on shoulder 42 with the transverse bores 54*a*, 54*b* of block 30*a* aligned with bore 40*a*, 40*b* of inner core assembly 32*a*. In order to assure the proper alignment and to ensure that the pistons 70*a*, 70*b* which would be operated within the bore 54*a* and 54*b* are properly engaged, there would be included a sleeve 57*a*, 57*b*, cylindrical in nature, which would slide within each of bores 54*a* and 54*b* and terminate within the notched area 31*a*, 31*b* in the body wall of inner core assembly 32*a*. When both sleeves 57*a*, 57*b* have been disposed within bores 54*a*, 54*b*, and engaged into the notches 31*a*, 31*b*, it is therefore assured that the bores 40*a*, 40*b* and bores 54*a*, 54*b* are properly aligned.

FIG. 1A further illustrates the outer core assembly 30*a* disposed about the inner core assembly 32*a* with piston members 70*a*, 70*b* having been inserted into each of the bores 54*a*, 54*b* of the outer core assembly 30*a*. The piston member 70*a*, as illustrated, would be threaded through a cap 71*a* which would be threaded into the bore 54*a* and sealed therein with O-rings. Piston 70*a* would be secured to the end of a threaded shaft 73*a* threaded through cap 71*a*, so that rotation of shaft 73*a* would move piston 70*a* in or out of bore 54*a* as needed. Piston 70*b* is similarly constructed with cap 71*b* and shaft 73*b*.

Figure 4:
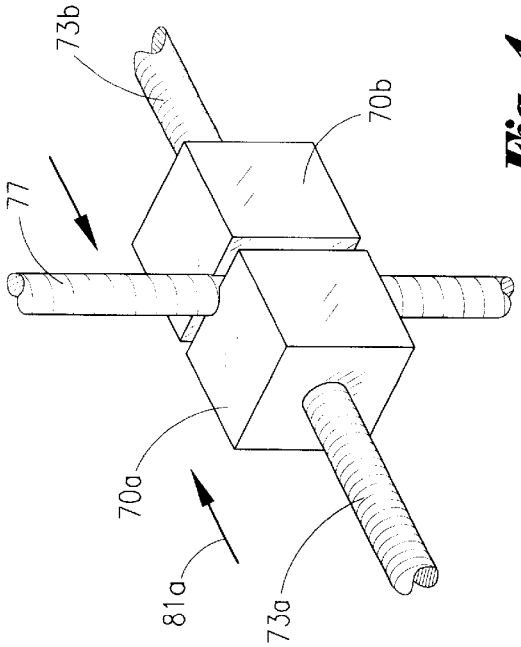
FIG. 4 is a perspective view of the pistons of the apparatus engaging a wireline.

Reference is now made to FIG. 4, where the pistons 70*a*, 70*b* are seen in isolated view being moved inwardly to grasp the wireline 77 to prevent fluid flow past that point. It should be noted that the pistons 70*a*, 70*b* may also be referred to as rams 70*a*, 70*b*. The pistons 70*a*, 70*b* move inwardly, as denoted by arrow 81*a*. For instance, rotation of shaft 73*a* moves piston 70*a* inward.

Returning to FIG. 1A, the sleeves 57*a*, 57*b* in the bores 54*a*, 54*b* would also be sealed with O-rings to assure that any pressure which would be contained within the apparatus 10*a* (and which is generated by the well) would be sealed therein. The numerous O-rings provided with the apparatus 10*a* are denoted by the letter "O". The details of the operation of the pistons are not novel in the sense that the pistons used would be the same pistons that are used quite commonly in the industry on such tools as the Bowen blowout preventors, commercially available from Bowen Oil Tools Inc. under the name Blowout Preventor. Additionally, details of the operation of the O-rings are well known in the art. O-rings are commercially available from Industrial Products Inc. under the name Viaton.

Reference is now made to FIG. 5 which illustrates a second embodiment of the apparatus, denoted as 10*b*, having a composite double outer core assembly 32*b*. FIG. 5 depicts an inner core assembly 32*b* having a bore 38 therethrough, an upper thread engagement 34 and a lower thread engagement 36. Unlike the inner core assembly 32*a* seen in FIG. 1A, this particular inner core assembly 32*b* would include a pair of lower transverse bores 40*a*, 40*b* and a pair of upper transverse bores 40*c*, 40*d* so as to accommodate two sets of pistons, namely 70*a*, 70*b* and 70*c*, 70*d*. As with the embodiment as seen in FIG. 1A, the apparatus 10*b* of FIG. 5 would include the pin members 47*a*, 47*b* which would function in the same manner. Again, there is also included the shoulder member 42 and the upper ring 45. As seen in particular in FIG. 5, the composite double outer core apparatus 30*b* comprises a lower 54*a*, 54*b* and an upper set of transverse bores 54*c*, 54*d*, which has been slidably engaged in the direction of arrow 60 onto the inner core assembly 32*b*. There is illustrated sleeves 57*a*, 57*b*, 57*c*, 57*d* of the type that would be slidably engaged into the bores 54*a*, 54*b*, 54*c*, 57*d*, respectively, of the block assemblies and would be latched within notches 31*a*, 31*b*, 31*c*, 31*d*. The double outer core apparatus 30*b* would accommodate a pair of pistons therein, namely top pistons 70*c*, 70*d* and bottom pistons 70*a*, 70*b*. This particular embodiment constitutes a more effective mode to be able to maintain a double seal via double pistons 70*a*, 70*b* and 70*c*, 70*d* against the wireline 77.

Figure 6:
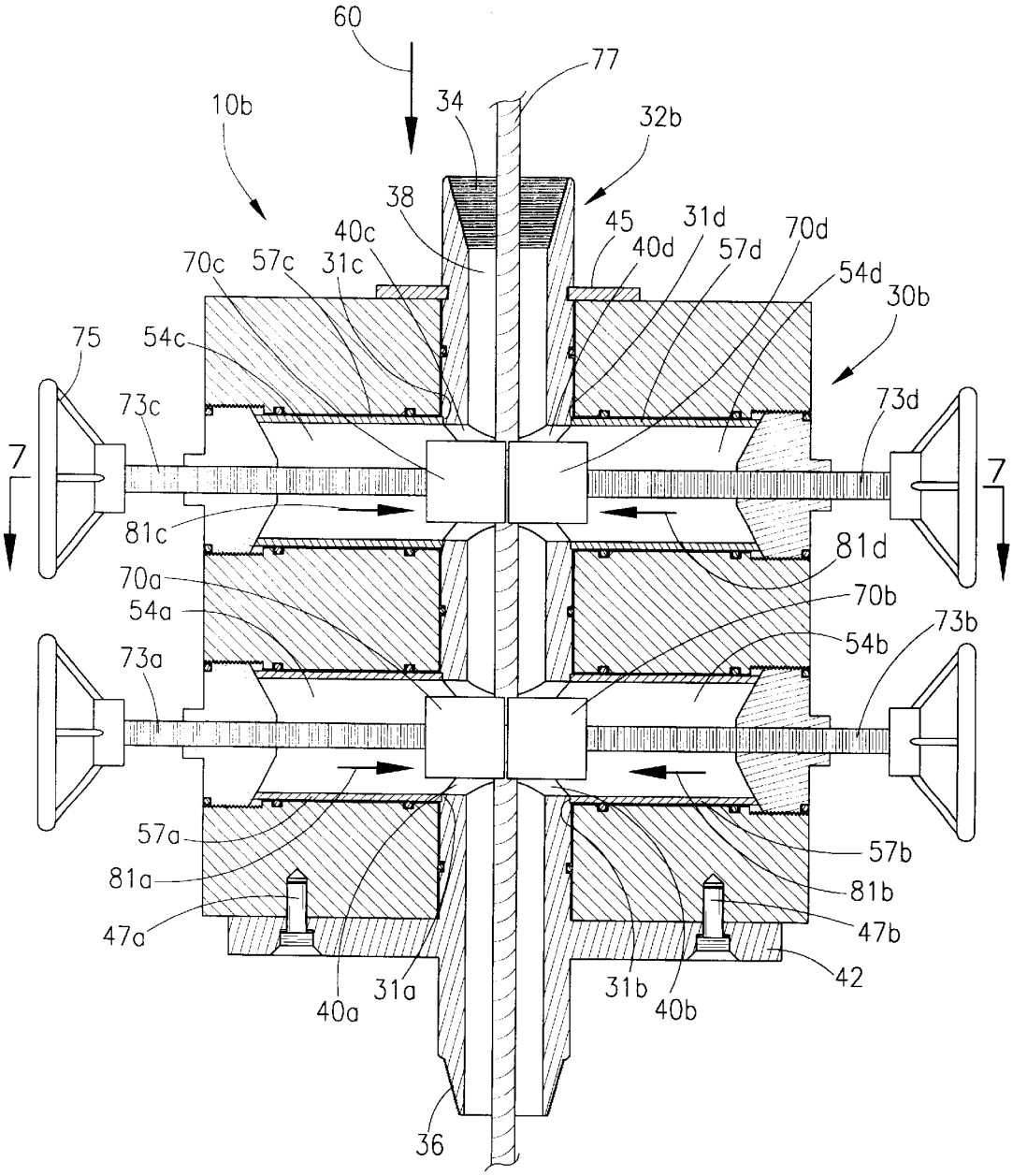
FIG. 6 is a cross-sectional view of the pistons of the double core assembly from FIG. 5 engaging a wireline.

FIG. 6 depicts a cross-sectional view of the pistons of the double core apparatus 30*b* in the closed position. As illustrated in FIG. 6, the double seal is seen with the upper set 70*c* and 70*d* and lower set of pistons 70*a*, 70*b* grasping the wireline 77 to effect a more effective seal than a single set of pistons 70*a*, 70*b* as was seen with the embodiment of FIG. 4. As seen in FIG. 6, the piston member 70*c* is connected to shaft 73*c* which may be operated either hydraulically or manually. Depending on the rotation of shaft 73*c*, the pistons move either interiorly or exteriorly relative to the outer core assembly 30*b*. Pistons 70*a*, 70*b* are moved inwardly as denoted by arrows 81*a*, 81*b*. Pistons 70*c*, 70*d* are moved inwardly as denoted by arrows 81*c*, 81*d*. Once pistons 70*a*, 70*b*, and pistons 70*c*, 70*d* are in place, they would seal against, for example, a wireline 77 which is disposed through the bore 38 in order to sealingly engage therein.

Figure 7:
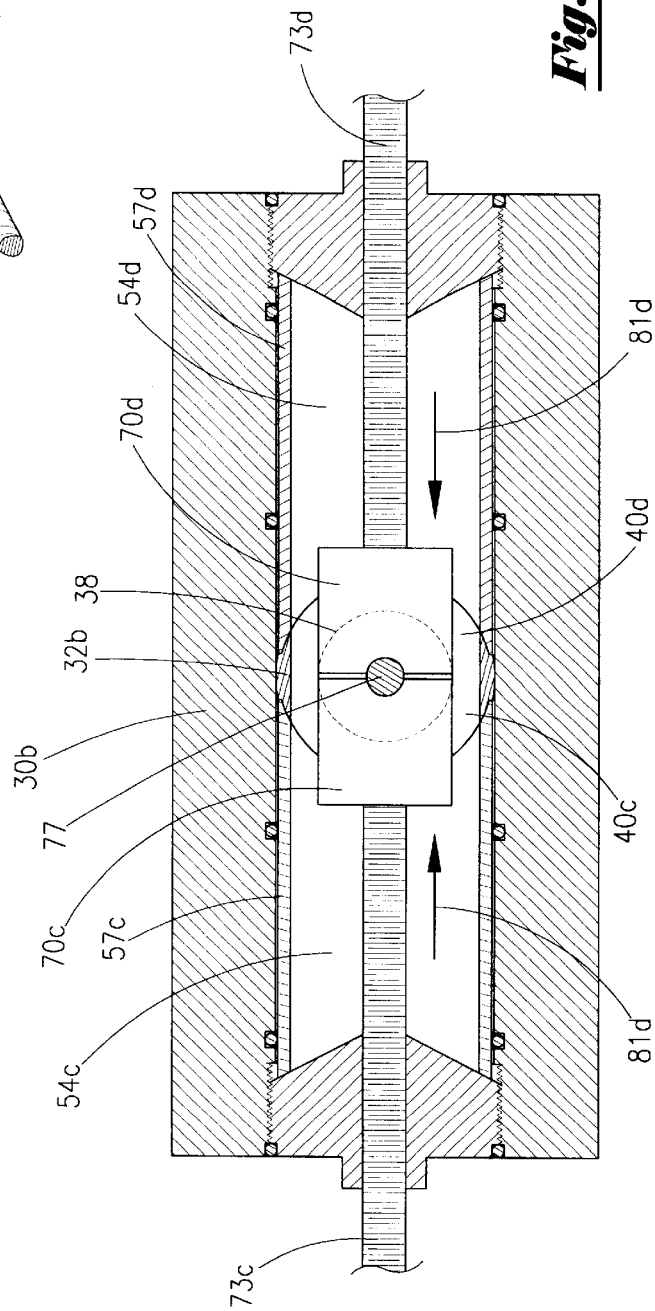
FIG. 7 is a cross-sectional top view of the view of the top pistons taken along line 7—7 of FIG. 6 engaging the wireline.
Figure 8:
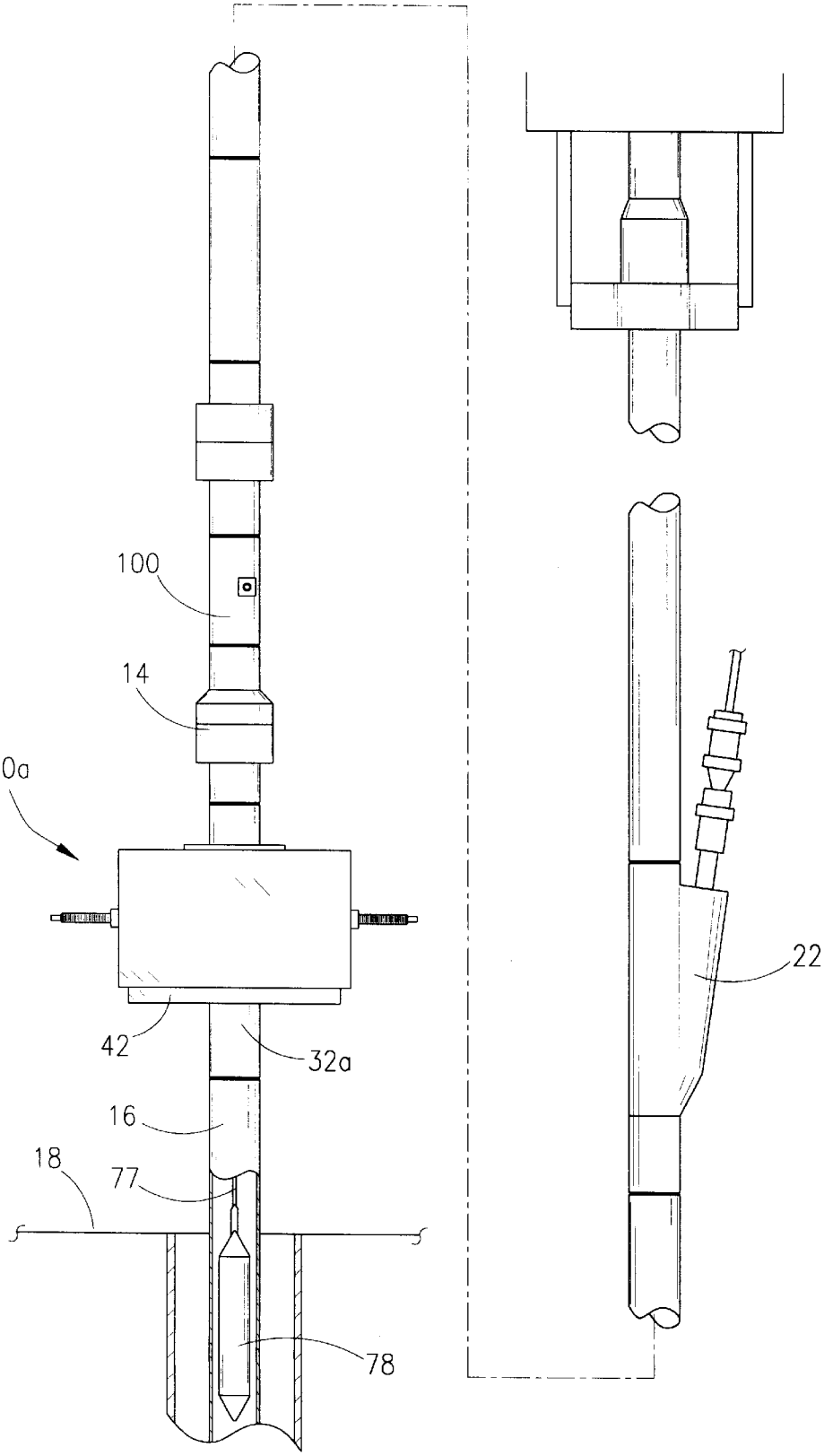
FIG. 8 is a schematic illustration of the single apparatus of the present invention seen in FIG. 1 positioned below a swivel for use during wireline work in the drill string above the rig floor.

FIG. 7 illustrates a partial cross-sectional top view of the top pistons 70*c*, 70*d* taken along line 7—7 of FIG. 6 moved inward engaging the wireline 77. Therefore, should there by any problem with wireline use, the positioning of the apparatus 10*b* below the locking or regular swivel 14, one would simply engage the pistons 70*a*, 70*b*, and pistons 70*c*, 70*d* to close off the bore 38 and sealingly engage wireline 77 which in turn prevents any fluid flow and/or pressure flow through the bore 38 above the apparatus 10*b*. In the event that the embodiment of the outer core assembly 30*b* and inner core assembly 32*b* has to take a very heavy load of the work string, there is a chance that the inner core assembly 32*b* will have some stretch due to the load. Should this occur, the transverse bores 54*a*, 54*b*, and bores 54*c*, 54*d* will become slightly misaligned with the bores 40*a*, 40*b* and 40*c*, 40*d* of the inner core assembly 32*b*, which could affect the ability of the pistons 70*a*, 70*b* and pistons 70*c*, 70*d* from moving in and out of the inner core assembly 32*b*. It should be noted that this misalignment would also be similar for the single embodiment seen in FIGS. 1A, 1B.

Therefore, in some cases it may be preferred to employ multiple points of sealing against the work string (i.e. pistons 70*a*, 70*b* and 70*c*, 70*d*) with multiple outer core assemblies 30*a* of the type illustrated in FIG. 1A. Therefore, instead of a single outer core assembly, there are a pair of outer core assemblies which would constitute an individual upper block 30*c* and a lower block 30*d* engaged upon a double bore inner core assembly 32*c* of the type as seen in FIG. 9.

As seen in FIG. 9, which is the preferred embodiment of the present invention, the upper outer core assembly 30*c* and lower outer core assembly 30*d* would be slidably disposed on the inner core assembly 32*c*. This differs from the double composite outer core assembly 30*b* seen in FIG. 5. In effect, the same assembly would be in place as was discussed in FIG. 1A, other than it being two outer core assemblies, i.e. an upper outer core assembly 30*c* and the lower outer core assembly 30*d*. Thus, in FIG. 9 there is illustrated a first 30*c* and second block 30*d* positioned on a double bore inner core assembly 32*c*, thereby creating the double piston effect of FIG. 5; however, two separate and distinct outer core assemblies 30*c*, 30*d* are employed which lessens the risk of failure and misalignment due to stretching when the apparatus is subjected to a load.

More particularly, a desirable effect of having two separate blocks as seen in FIG. 9 is that should a significant downward pull be exerted on the drill string 16, and some stretching occur in the inner core assembly 32*c*, each separate outer core assembly 30*c*, 30*d* will move with the stretch, and any misalignment of the transverse bores of the first outer core assembly with the inner core assembly does not necessarily mean misalignment of the transverse bores of the second outer core assembly with the inner core assembly.

Referring again to FIG. 8, it is important to understand that one of the functions of the apparatus 10*a* is to allow the apparatus 10*a* to be placed in the drill string. When it is placed in the drill string 16, this in effect would allow one to seal off the opening in the apparatus 10*a* where there may be wireline 77 with a bottom hole assembly 78 attached thereto which extends therethrough and to undertake any curative or maintenance work above the apparatus 10*a* on the rig floor 18. However, one of the problems is that once the apparatus 10*a* is sealed off, the apparatus 10*a* may have to carry the entire weight of the drill string which may be hundreds of thousands of pounds or even more.

One of the reasons that the outer core assemblies seen in FIG. 9 are kept separate is that when the entire weight of the drill string is pulled on the inner core assembly 32*c*, there is some stretching of the inner core assembly 32*c*. Therefore, by having separate assemblies 30*c*, 30*d*, when any stretching occurs in one outer core assembly, then it does not necessarily follow that the other outer core assembly would be warped or damaged in the same way since they are separate from one other. If the pair of assemblies were kept in one block, then when the stretching of the inner core assembly 32 would take place, it is possible that the block itself would be compromised and the pistons may be pulled upward or downward as the case may be thereby creating the misalignment. In FIG. 9, because each outer core assembly 32*c*, 32*d* is allowed to float separately from one another, any deformation of one outer core assembly does not necessarily mean the deformation of the other outer core assembly.

As noted earlier, each apparatus includes O-rings, also called polypacks, to keep well pressure from leaking out from the well into the atmosphere which, as those of ordinary skill in the art will appreciate, could lead to a safety risk. O-rings are well known in the art. For instance, in FIG. 1A, the outer core assembly 30*a* has O-rings, such as seen at 79*a* which will seal against the upper sections of outer core assembly 30*a* to maintain pressure internally. Furthermore, outer core assembly 30*a* will have O-ring 79*b* to seal against the sleeve 57*a* when locked in place of the whole assembly to maintain internal well pressure. Other O-rings are denoted by the letter "O". The piston members that are disposed within transverse bores 54*a*, 54*b* has O-rings on the outside to seal against the locking sleeve inside, as the piston members are hydraulically or manually closed to seal against the medium that is within the work string such as wireline, coiled tubing, snubbing pipe, etc.

FIG. 8 illustrates a single apparatus 10*a* as was discussed earlier positioned below the swivel 14 and above a drill pipe 16. It is important that the apparatus 10*a* be positioned below a swivel 14 when one is using a side entry device 22 as illustrated in FIG. 8, and one wishes to rotate the drill string in order to create downhole torque. The swivel 14 may be a locking swivel or regular swivel. If wireline 77 is rigged up and the apparatus 10*a* is above swivel 14, and one would want to rotate the drill string, rotation would cause the wireline 77 to become wrapped around the entire upper portion of the lubricator. Therefore, the swivel 14 allows the rotary table to rotate the lower portions of string while not rotating the upper part. When that occurs, the apparatus 10*a* would likewise rotate with the lower portions of string below the swivel 14. However, according to the teachings of the present invention, in the event that a problem develops, the apparatus 10*a* would be closed. Remedial curative action could then be undertaken.

As was discussed earlier, FIG. 9 illustrates multiple outer core assemblies 30*c*, 30*d* positioned below the swivel 14. This would be similar to the system as seen in FIG. 8 but for the fact that there are two outer core assemblies 30*c*, 30*d* for the reasons as were discussed earlier.

Figure 10:
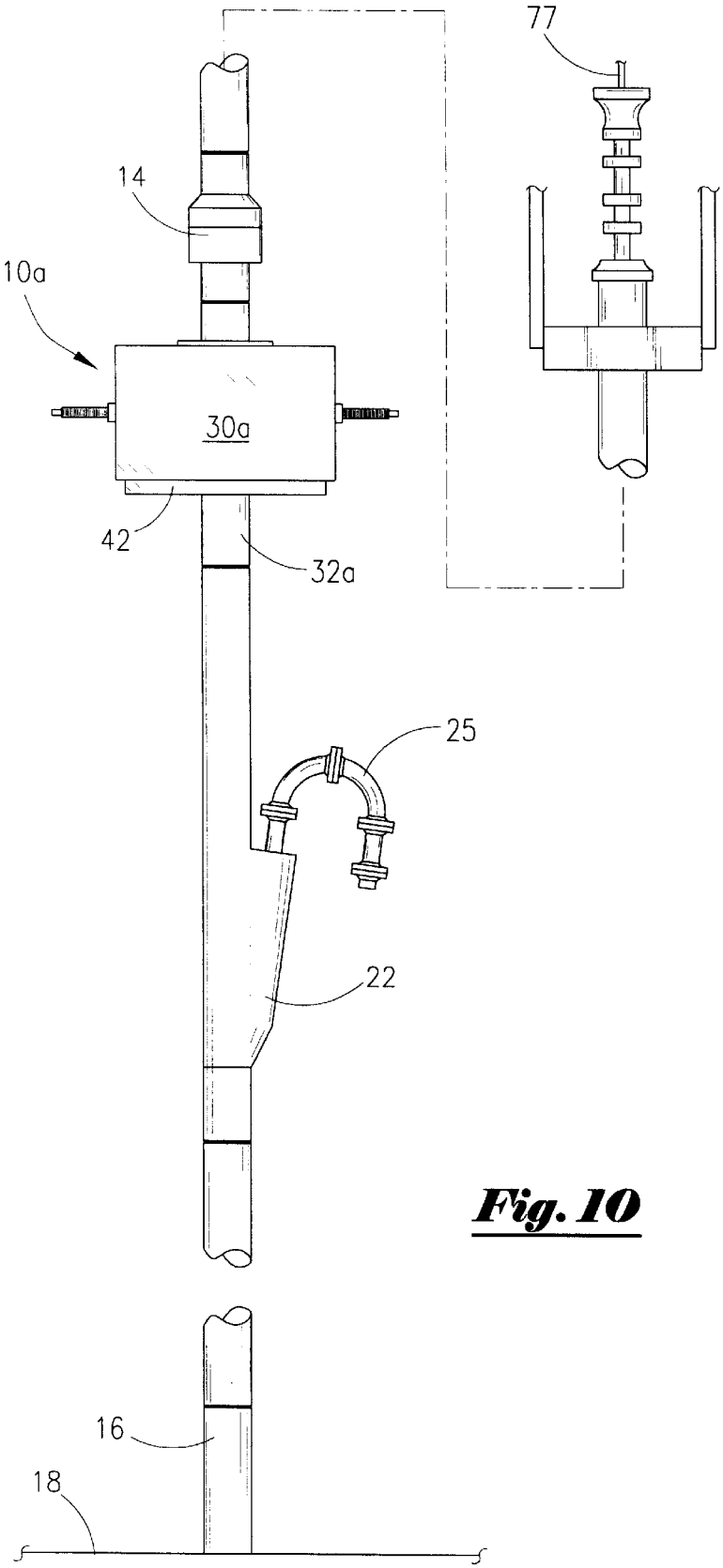
FIG. 10 is a schematic illustration of the apparatus below the swivel and above a side entry sub above the rig floor.

Turning now to FIG. 10, there is illustrated the apparatus 10*a* below a swivel, which can be a regular or locking swivel, and above a side entry sub 22 above the rig floor 18. Should a problem occur while the wireline is being used, and it becomes necessary to close apparatus 10*a*, one would close the apparatus 10*a* against the wireline to seal the pressure below it. The pressure above apparatus 10*a* can be bleed off and work can be done above the apparatus 10*a* as set out earlier. Also, the pressure line 25 can be used to kill the well below the apparatus 10*a*.

The apparatus 10*a* is positioned below a swivel 14 so that curative work may be done on that portion of the lubricator above the swivel 14 during use. In all cases, again, when this work would go on, the assembly 10*a* would be in the closed position, that is sealing off the bore where the wireline (or other tubulars such as coiled tubing) is concentrically disposed so as to prevent any pressure and/or fluid flow above the assembly 10*a* while work is going on above the apparatus 10*a*. In the FIG. 10, a side entry sub 22 is rigged up with a fluid injection line 25 to the side out of the side entry 22. Tools would be entering down the center bore and the apparatus 10*a* can be closed to control well pressure below it. Once closed, any tools above it that need work or if any rubbers in the packoff need to be changed, the operator can do so. Additionally, the side entry tool 22 will allow you to still inject heavy fluids via the fluid injection line 25, or in the alternative, to bleed off pressure from below the apparatus 10*a*.

Figure 11:
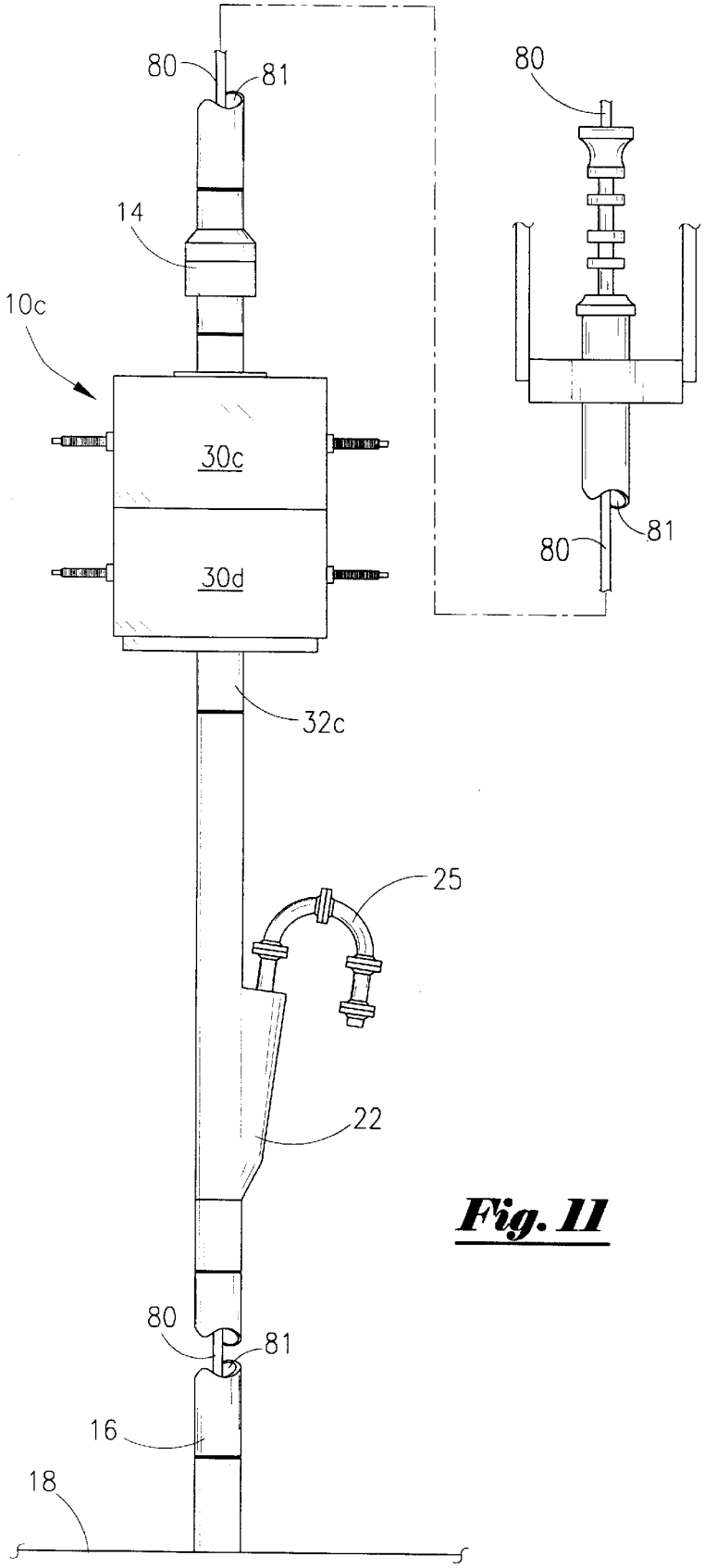
FIG. 11 is a schematic illustration of outer core assemblies positioned below the swivel but above a side entry sub in the drill string above the rig floor.

It should be noted that as an additional embodiment, it is possible to have multiple outer core assemblies utilized below the swivel 14 but above a side entry device 22 such as seen in FIG. 11. Additionally, FIG. 11 shows a coiled tubing string 79 being concentrically lowered into the drill pipe 16, as is well understood by those of ordinary skill in the art. An annular space 80 is created by the coiled tubing string 79 concentrically positioned within the drill pipe 16.

Applications to chemical cut or electric line logging under high pressure and wherein tubing connections have a grease head on top to control well pressure can be used with this invention. This application would allow one to eliminate the Bowen quick connects which are normally used without the elevators and not able to pull on the tubing below when chemical cutting. Also, the elevators of the block would still be latched onto the tubing or drill pipe just below the grease head. When doing many types of applications, one is able to pull while chemical cutting the pipe below with heavy loads and still have availability to rotate the apparatus while prior art blow out preventors are unable to rotate or withstand heavy loads during such operations.

Figure 12:
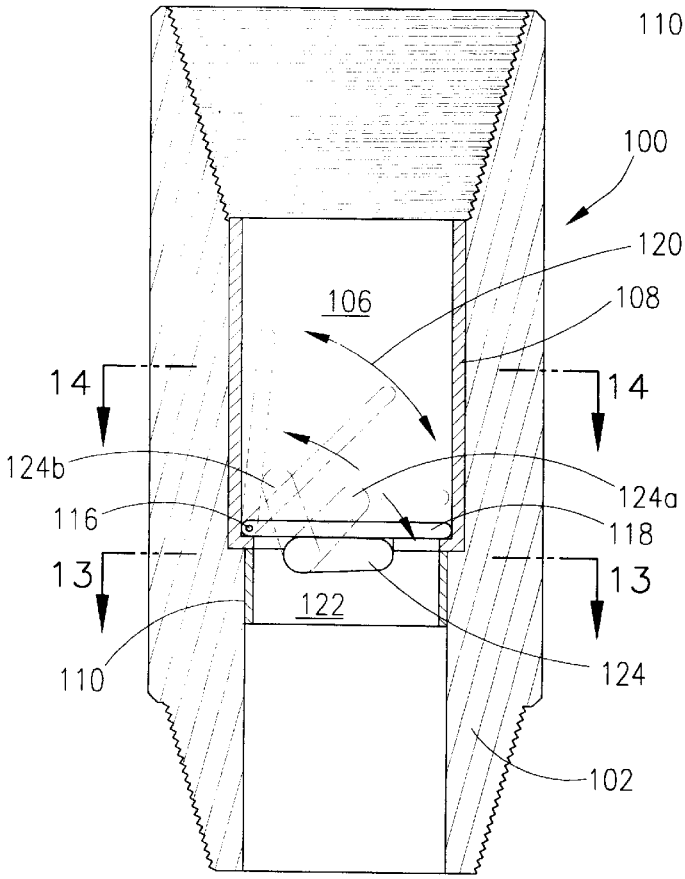
FIG. 12 is a cross-sectional view of the preferred embodiment of the trap door assembly.

Referring now to FIG. 12, a cross-sectional view of the preferred embodiment of the trap door assembly 100 will now be described. Please note that the trap door assembly 100 is shown positioned above the swivel 14 in FIG. 8. Returning to FIG. 12, the trap door assembly 100 consist of a generally cylindrical sub 102 that has an outer surface and an inner bore 104. The trap door assembly includes a sleeve assembly 106 disposed within the inner bore 104. The sleeve assembly 106 contains a first diameter surface 108 that extends to a reduce diameter second surface 110. As seen in FIG. 12, a radial surface 112 of the sleeve assembly 106 seats on radial surface 114 of the cylindrical sub 102.

The sleeve assembly 106 contains a pivot point 116 for a pin, with the trap door 118 being pivoted from a closed position to an opened position as shown by the arrow 120. It should be noted that the trap door 118 is shown in three different positions within the sleeve assembly 106 by the shadow lines. The trap door assembly 100 also contains the kick gate assembly 122 which is disposed on the reduced diameter second surface 110. The kick gate assembly 122 is used to open the trap door 118 with the kick arm 124.

As seen in FIG. 8, the trap door assembly 100 is connected on top of the swivel 14. More specifically, the cylindrical sub 102 has an internal thread 125*a* that connects to a portion of the lubricator, and an external thread 125*b* that connects to the swivel 14 as seen in FIG. 8. With this design, weight of the drill string 16 is transmitted through the cylindrical sub 102, but is not transmitted to the separate sleeve assembly 106. Therefore, the weight of the drill string 16, as well as torque, will not be transferred to the sleeve 106. In prior art devices, the weight and/or torque would structurally effect the trap door which in turn causes the trap door to fail.

Figure 13:
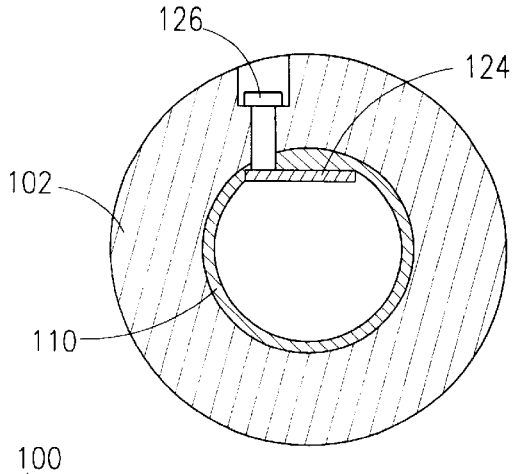
FIG. 13 is a cross-sectional view of the trap door assembly taken from line 13—13 of FIG. 12.

FIG. 13 is a cross-sectional view of the trap door assembly taken from line 13—13 of FIG. 12. As seen in FIG. 13, the kick arm 124 pivots with the rotation of the shaft 126, wherein the shaft 126 and kick arm 124 are connected. The shaft 126 is disposed through the wall of the cylindrical sub 102, and the shaft 126 may contain a head with a profile therein for ease of rotating the shaft 126.

Figure 14:
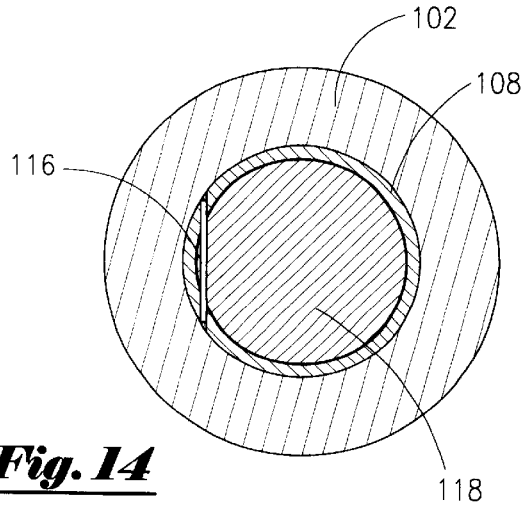
FIG. 14 is a cross-sectional view of the trap door assembly taken from line 14—14 of FIG. 12.

Referring now to FIG. 14, a cross-sectional view of the trap door assembly taken from line 14—14 of FIG. 12 will now be described. Generally, FIG. 14 shows the trap door 118 in the closed position within the first surface 108 of the sleeve assembly 106, with the sleeve assembly 106 being disposed within the cylindrical sub 102 as previously set forth.

In operation, the kick arm 124 is moved by the rotation of the shaft 126 wherein the kick arm 124 will open the trap door 118, as better seen in FIG. 12 by the shadow lines denoted 124*a*, 124*b*. Thus, the operator would open the trap door 118 via the kick gate assembly 122. The wireline (or other tubulars such as coiled tubing) can then be lowered therethrough. While the wireline is extending therethrough, trap door 118 will remain opened. Once the wireline and any downhole assembly attached thereto is pulled up through the sleeve assembly 106, the trap door 118 will close. The trap door 118 may be spring loaded to close.

Once the trap door 118 is closed, the wireline tools will be prevented from falling downhole. Thus, once the wireline and downhole assembly are above the tool trap 100, the operator would not have to worry about the tools falling back downhole if, for instance, the operator runs the tool string into the top of the lubricator. Additionally, the weight of the drill string, as well as any torque, is not transmitted to the sleeve assembly 106 thereby preventing damage to the trap door 118 and/or to the kick gate assembly 122. In one embodiment, a blade may be positioned on the trap door 118, and when the wireline is extending therethrough, the operator could close the trap door 118 and the blade disposed on the trap door 118 can cut the wireline.

The foregoing embodiments are presented by way of example only; the scope of the present invention is to be limited only by the following claims and any equivalents thereof.

Once the trap door 118 is closed, the wireline tools will be prevented from falling downhole. Thus, once the wireline and downhole assembly are above the tool trap 100, the operator would not have to worry about the tools falling back downhole if, for instance, the operator runs the tool string into the top of the lubricator. Additionally, the weight of the drill string, as well as any torque, is not transmitted to the sleeve assembly 106 thereby preventing damage to the trap door 118 and/or to the kick gate assembly 122. In one embodiment, a blade may be positioned on the trap door 118, and when the wireline is extending therethrough, the operator could close the trap door 118 and the blade disposed on the trap door 118 can cut the wireline.

The foregoing embodiments are presented by way of example only; the scope of the present invention is to be limited only by the following claims and any equivalents thereof.

I claim:

1. An apparatus for use in a drill string comprising:

an inner core assembly having a first and second transverse bore, said inner core assembly having a shoulder formed thereon, and wherein said inner core assembly has a first end and a second end;

a first outer core assembly slidably disposed about said inner core assembly and resting on said shoulder, said first outer core assembly having a first and second transverse bore that is aligned with said first and second transverse bore of said inner core assembly;

first piston means, disposed within said first and said second transverse bore of said first outer core assembly, for closing an internal longitudinal bore of said inner core assembly;

and wherein said first end of said inner core assembly is connected to the drill string and said second end is operatively connected to a swivel.

2. The apparatus of claim 1 wherein said inner core assembly has contained thereon an indentation, and the apparatus further comprises:

a ring inserted into said indentation, said ring abutting a top surface of said first outer core assembly.

3. The apparatus of claim 2 wherein said first piston means comprises:

a first piston member disposed within the first transverse bore of said first outer core assembly;

a second piston member disposed within the second transverse bore of said first outer core assembly;

means for moving said first and second piston member into said internal longitudinal bore of said inner core assembly in order to close said internal longitudinal bore.

4. The apparatus of claim 3 wherein said first piston member includes a first sleeve disposed within said first transverse bore of said first outer core assembly; and wherein said second piston member includes a second sleeve disposed within said second transverse bore of said first outer core assembly.

5. The apparatus of claim 4 further comprising:

a third and fourth transverse bore positioned within said inner core assembly;

a third and fourth transverse bore positioned within said first outer core assembly that is aligned with said third and fourth transverse bore of said inner core assembly; and second piston means, disposed within said third and said fourth transverse bore of said first outer core assembly, for closing said internal longitudinal bore of said inner core assembly.

6. The apparatus of claim 1 further comprising:

a second outer core assembly slidably disposed about said inner core assembly and resting on a first outer surface of said first outer core assembly, said second outer core assembly having a third and fourth transverse bore that is aligned with a third and fourth transverse bore located within said inner core assembly.

7. The apparatus of claim 6 further comprising:

second piston means, disposed within said third and said fourth transverse bore of said second outer core assembly, for closing said internal longitudinal bore of said inner core assembly.

8. The apparatus of claim 7 wherein said inner core assembly has contained thereon an indentation, and the apparatus further comprises:

a ring inserted into said indentation, said ring abutting a top surface of said second outer core assembly.

9. The apparatus of claim 8 wherein said first piston means comprises:

a first piston member disposed within a first sleeve that is positioned within the first transverse bore of said first outer core assembly;

a second piston member disposed within a second sleeve that is positioned within the second transverse bore of said first outer core assembly;

and wherein said second piston means comprises:

a third piston member disposed within a third sleeve that is positioned within the third transverse bore of said second outer core assembly;

a fourth piston member disposed within a fourth sleeve that is positioned within the fourth transverse bore of said second outer core assembly;

and wherein said apparatus further comprises:

means for moving said first, second, third, and fourth piston members into said internal longitudinal bore of said inner core assembly in order to close said internal longitudinal bore.

10. The apparatus of claim 5 further comprising a pin means for maintaining said inner core assembly in line with said first outer core assembly.

11. A method of sealing off flow in a drill string during wireline operations comprising:

providing an apparatus comprising an inner core assembly having a first and second transverse bore, said inner core assembly having a shoulder formed thereon; a first outer core assembly slidably disposed about said inner core assembly and resting on said shoulder, said first outer core assembly having a first and second transverse bore that is aligned with said first and second transverse bore of said inner core assembly; first piston means, disposed within said first and said second transverse bore of said first outer core assembly, for closing an internal longitudinal bore disposed through said inner core assembly;

connecting the drill string to a first end of said inner core assembly;

transmitting the weight of the drill string to said inner core assembly;

rotating the drill string so that a torque is created;

transmitting the torque through said inner core assembly;

terminating the rotation of the drill string;

closing said first piston means in order to seal off the internal longitudinal bore of said inner core assembly.

12. The method of claim 11 further comprising:

opening said first piston means so that the internal longitudinal bore of said inner core assembly is unsealed;

providing a wireline within said internal longitudinal bore of said inner core assembly, and wherein said wireline has attached thereto a down hole assembly;

lowering the downhole assembly into the drill string;

closing said first piston means about the wireline within said internal longitudinal bore of said inner core assembly.

13. The method of claim 12 further comprising:

performing curative work on the wireline above said first piston means;

opening said first piston means so that the internal longitudinal bore of said inner core assembly is unsealed;

pulling out the drill string with the down hole assembly.

14. An apparatus for use in a tubular string comprising:

an inner cylindrical core assembly having a first and second transverse bore, said inner cylindrical core assembly having a shoulder formed thereon, and wherein said inner cylindrical core assembly has a first end and a second end, and wherein said shoulder contains a first aperture therein;

a first outer core assembly slidably disposed about said inner cylindrical core assembly and resting on said shoulder, said first outer core assembly having a first and second transverse bore that is aligned with said first and second transverse bore of said inner cylindrical core assembly, and wherein said first outer core assembly contains a second aperture therein;

a pin member disposed through said first aperture and said second aperture, and wherein said pin member allows a longitudinal movement of said first outer core assembly relative to said inner cylindrical core assembly;

first piston means, disposed within said first and said second transverse bore of said outer core assembly, for closing an internal longitudinal bore of said inner cylindrical core assembly;

and wherein said first end of said inner cylindrical core assembly is connected to the tubular string.

15. The apparatus of claim 14 wherein said first piston means comprises:

a first ram member disposed within the first bore of said first outer core assembly;

a second ram member disposed within the second bore of said first outer core assembly;

means for moving said first and second ram members into said internal longitudinal bore of said inner cylindrical core assembly in order to close said internal longitudinal bore.

16. The apparatus of claim 15 wherein said inner cylindrical core assembly has contained an indentation thereon and the apparatus further comprises:

a ring inserted into said indentation, said ring abutting a top surface of said first outer core assembly, and wherein said second end of said inner cylindrical core assembly is operatively connected to a swivel so that said inner cylindrical core assembly can be rotated with said tubular string.

17. The apparatus of claim 16 wherein said first ram member includes a first sleeve disposed within said first transverse of said first outer core assembly; and wherein said second ram member includes a second sleeve disposed within said second transverse bore of said first outer core assembly.

18. The apparatus of claim 17 further comprising:

a third and fourth transverse bore positioned within said inner cylindrical core assembly;

a third and fourth transverse bore positioned within said first outer core assembly therein that is aligned with said third and fourth transverse bore of said inner cylindrical core assembly; and second piston means, disposed within said third and said fourth transverse bore of said first outer core assembly, for closing said internal longitudinal bore of said inner cylindrical core assembly.

19. The apparatus of claim 14 further comprising:

a second outer core assembly slidably disposed about said inner cylindrical core assembly and resting on a top surface of said first outer core assembly, said second outer core assembly having a third and fourth transverse bore that is aligned with a third and fourth transverse bore located within said inner cylindrical core assembly.

20. The apparatus of claim 19 further comprising:

second piston means, disposed within said third and said fourth transverse bore of said second outer core assembly, for closing the internal longitudinal bore of said inner cylindrical core assembly.

21. The apparatus of claim 20 wherein said inner cylindrical core assembly has contained an indentation thereon and the apparatus further comprises:

a ring inserted into said indentation, said ring abutting a top surface of said second outer core assembly.

22. The apparatus of claim 21 wherein said first piston means comprises:

a first ram member disposed within the first transverse bore of said first outer core assembly;

a second ram member disposed within the second transverse of said first outer core assembly;

and wherein said second piston means comprises:

a third ram member disposed within the third transverse bore of said second outer core assembly;

a fourth ram member disposed within the fourth transverse bore of said seocnd outer core assembly;

and wherein the apparatus further comprises:

means for moving said first, second, third, and fourth ram members into said internal longitudinal bore of said inner cylindrical core assembly in order to close said internal longitudinal bore.

23. The apparatus of claim 22 wherein said second end of said inner cylindrical core assembly is operatively connected to a swivel so that said inner cylindrical core assembly can be rotated with said tubular string.

24. A method of sealing off flow in a work string comprising:

providing an apparatus having an inner core assembly having an internal bore, said inner core assembly having a shoulder formed thereon, and wherein said inner core assembly has a first end and a second end; a first outer core assembly slidably disposed about said inner core assembly and resting on said shoulder;

connecting the work string to the first end of said inner core assembly;

transmitting the weight of the work string to said inner core assembly;

rotating the work string within the well bore so that a torque is created;

transmitting the torque from the work string to said inner core assembly;

terminating the rotation of the work string;

providing a concentric tubular member within said internal bore of said inner core assembly;

lowering the concentric tubular member into the work string;

closing said first piston member and said second piston member about the concentric tubular member within said internal bore of said inner core assembly.

25. The method of claim 24 further comprising:

pumping a fluid into the work string below the apparatus;

monitoring a pressure within the work string;

opening said first piston member and said second piston member so that the internal bore of said inner core assembly is unsealed;

pulling the concentric tubular member out of the work string.

26. The method of claim 25 wherein the concentric tubular member is a wireline.

27. An apparatus for use in a tubular string, comprising:

an inner core assembly, connected between a swivel on its upper end and the tubular string below;

a first outer core assembly, having a central bore for slidable engagement around a portion of the inner core assembly;

a first and second transverse bore in the first outer core assembly, corresponding to a first and second transverse bore in the inner core assembly;

a first sleeve member disposed within said first transverse bore of said outer core assembly and a second sleeve member disposed within said second transverse bore of said first outer core assembly, said first and second sleeve members aligning with the first and second transverse bore of the inner core assembly;

a first piston positioned within said first sleeve and a second piston positioned within said second sleeve for sealing off a longitudinal passageway in the inner core assembly.

28. The apparatus in claim 27 further comprising a shoulder formed on a wall of the inner core assembly upon which the first outer core assembly rests.

29. The apparatus in claim 28 further comprising a first aperture in said first outer core assembly and a second aperture in said inner core assembly; a pin slidably disposed within said first aperture and said second aperture so that said first outer core assembly is allowed to longitudinally move relative to said inner core assembly.

30. The apparatus in claim 29 further comprising means for moving said first and second piston from an open position to a closed position.

31. The apparatus in claim 30 further comprising a ring positioned above the first outer core assembly to maintain the first outer core assembly in place on the inner core assembly.

32. The apparatus in claim 27 further comprising at least a second outer core assembly positioned on the first outer core assembly, the second outer core assembly further comprising a second set of transverse bores which align with a second set of transverse bores in the central core assembly.

33. The apparatus of claim 32 further comprising a first aperture in said first outer core assembly and a second aperture in said inner core assembly; a pin slidably disposed within said first aperture and said second aperture so that said first outer core assembly is allowed to longitudinally move relative to said inner core assembly.

34. The apparatus in claim 33, wherein the first and second outer core assembly is able to float with any stretching or warping of the inner core assembly to eliminate any misalignment of the transverse bores of the first and second outer core assembly with the transverse bores of the inner core assembly.

35. The apparatus of claim 30 further comprising:

a sub member attached to an upper end of the swivel, said sub member having an inner bore therein aligned with the longitudinal passageway of the inner core assembly, said inner bore of said sub member having a shoulder;

a trap door assembly comprising: a sleeve mounted within said inner bore of said sub member; and a trap door pivotly mounted to said sleeve, said trap door having an open position and a closed position.

36. The apparatus of claim 35 wherein said trap door assembly further comprises:

a kick gate assembly operatively associated with said sleeve, said kick gate assembly capable of moving said trap door from a closed position to an open position; and, wherein a blade device is capable of cutting a wireline extending through said inner bore of said sub member.

37. A method of sealing off flow in a tubular string during coiled tubing operations comprising:

providing an apparatus having: an inner core assembly with a first and second transverse bore, said inner core assembly having a shoulder formed thereon; an internal bore formed through said inner core assembly; a first outer core assembly slidably disposed about said inner core assembly and resting on said shoulder; and, piston means, disposed within said first outer core assembly, for closing the internal bore of said inner core assembly;

connecting the tubular string to a first end of said inner core assembly;

connecting a swivel to a second end of said inner core assembly;

transmitting the weight of the tubular string to said inner core assembly;

lowering a coiled tubing into the tubular string and through the internal bore of said inner core assembly, the coiled tubing disposed within said tubular string creating an annular space;

rotating the tubular string so that a torque is created;

transmitting the torque through said inner core assembly;

terminating the rotation of the tubular string;

closing said piston means about the coiled tubing in order to seal off the annular space;

pumping a fluid through a side entry sub located below the apparatus, the fluid being pumped into the annular space.

38. The method of claim 37 further comprising:

opening said piston means so that the annular space is unsealed;

running into the well bore with the coiled tubing to a desired depth;

closing said piston means about the coiled tubing thereby closing the annular space.

39. The method of claim 38 further comprising:

opening said piston means so that the annular space is opened;

pulling on the tubular string;

transmitting the weight of the tubular string through said outer core assembly;

rotating the tubular string so that the torque is created;

transmitting the torque to the outer core assembly;

terminating the rotation of the tubular string;

pulling the coiled tubing out of the tubular string.

* * * * *